US007203982B2

(12) United States Patent
Cohan

(10) Patent No.: US 7,203,982 B2
(45) Date of Patent: Apr. 17, 2007

(54) FUTON MATTRESS COVER

(76) Inventor: Ernesto Cohan, 254 Golden Beach Dr., Golden Beach, FL (US) 33160

( * ) Notice: Subject to any disclaimer, the term of this patent is extended or adjusted under 35 U.S.C. 154(b) by 170 days.

(21) Appl. No.: 11/057,796

(22) Filed: Feb. 15, 2005

(65) Prior Publication Data

US 2005/0217028 A1 Oct. 6, 2005

Related U.S. Application Data

(60) Provisional application No. 60/558,203, filed on Apr. 1, 2004.

(51) Int. Cl.
*A47G 9/02* (2006.01)

(52) U.S. Cl. ..... 5/499; 5/497

(58) Field of Classification Search ..... 5/499, 5/737, 738, 497, 482
See application file for complete search history.

(56) References Cited

U.S. PATENT DOCUMENTS

| | | | | | |
|---|---|---|---|---|---|
| 2,942,280 | A * | 6/1960 | May, Jr. | ..... | 5/497 |
| 4,192,032 | A * | 3/1980 | Geraci | ..... | 5/497 |
| 4,962,546 | A * | 10/1990 | Vitale | ..... | 5/497 |
| 4,980,941 | A * | 1/1991 | Johnson, III | ..... | 5/497 |
| 4,985,953 | A * | 1/1991 | Seago | ..... | 5/497 |
| 5,056,441 | A * | 10/1991 | Seago | ..... | 112/2.1 |
| 5,127,115 | A * | 7/1992 | Williams et al. | ..... | 5/497 |
| 5,133,097 | A * | 7/1992 | Pyles | ..... | 5/623 |
| 5,249,322 | A * | 10/1993 | Seago | ..... | 5/499 |
| 5,603,132 | A * | 2/1997 | Zafiroglu | ..... | 5/497 |
| 5,636,393 | A * | 6/1997 | Zafiroglu et al. | ..... | 5/499 |
| 6,199,231 | B1 * | 3/2001 | Zafiroglu | ..... | 5/497 |
| 6,272,701 | B1 * | 8/2001 | Zafiroglu | ..... | 5/499 |
| 6,463,606 | B2 * | 10/2002 | Barker et al. | ..... | 5/500 |
| 6,618,880 | B1 * | 9/2003 | Chase | ..... | 5/500 |
| 6,883,193 | B2 * | 4/2005 | Brooks et al. | ..... | 5/497 |
| 6,971,130 | B2 * | 12/2005 | Chase | ..... | 5/500 |
| 7,007,326 | B2 * | 3/2006 | Tsiarkezos | ..... | 5/497 |
| 2004/0088790 | A1 * | 5/2004 | Chase | ..... | 5/484 |
| 2004/0172754 | A1 * | 9/2004 | Brooks et al. | ..... | 5/499 |
| 2004/0231054 | A1 * | 11/2004 | Tsiarkezos | ..... | 5/499 |
| 2005/0039262 | A1 * | 2/2005 | Chase | ..... | 5/500 |
| 2005/0177942 | A1 * | 8/2005 | Finn | ..... | 5/499 |
| 2005/0217028 | A1 * | 10/2005 | Cohan | ..... | 5/499 |

* cited by examiner

*Primary Examiner*—Robert G. Santos
(74) *Attorney, Agent, or Firm*—Charles E. Temko

(57) ABSTRACT

A futon mattress cover having a partially elastic periphery eliminating the need of slide fasteners. The cover is preferably formed from elastomeric material to assure a snug fit.

1 Claim, 3 Drawing Sheets

FUTON MATTRESS COVER

RELATED APPLICATION

Reference is made to my copending application, Ser. No. 60/558,203; filed Apr. 1, 2004, to which a claim of priority is made.

BACKGROUND OF THE INVENTION

This invention relates generally to the field of covers for mattresses, and more particularly to improved covers for futon mattresses which form part of an article of furniture.

In recent years, futon type furniture has become increasingly popular, replacing so-called sleeper couches by reason of lower cost of manufacture and convenience in use. The mattresses are normally covered with conventional ticking. It is also known in the prior art to provide a decorative cover which is installed using slide fasteners which are peripherally located and often results in an objectional appearance.

SUMMARY OF THE INVENTION

Briefly stated, the invention contemplates the provision of an improved cover for futon mattresses, in which the use of slide fasteners has been eliminated to be substituted by a downwardly-extending opening having a peripheral edge which is at least partially elastic. The cover is fabricated preferably using textile materials which are substantially stretchable to accommodate for variance in thickness of the mattress, and limited variance in length and width. In a preferred embodiment, an additional flap is provided which depends from a rear panel to partially cover the frame of the futon which readily folds when the futon is moved to sleeping configuration.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 1:
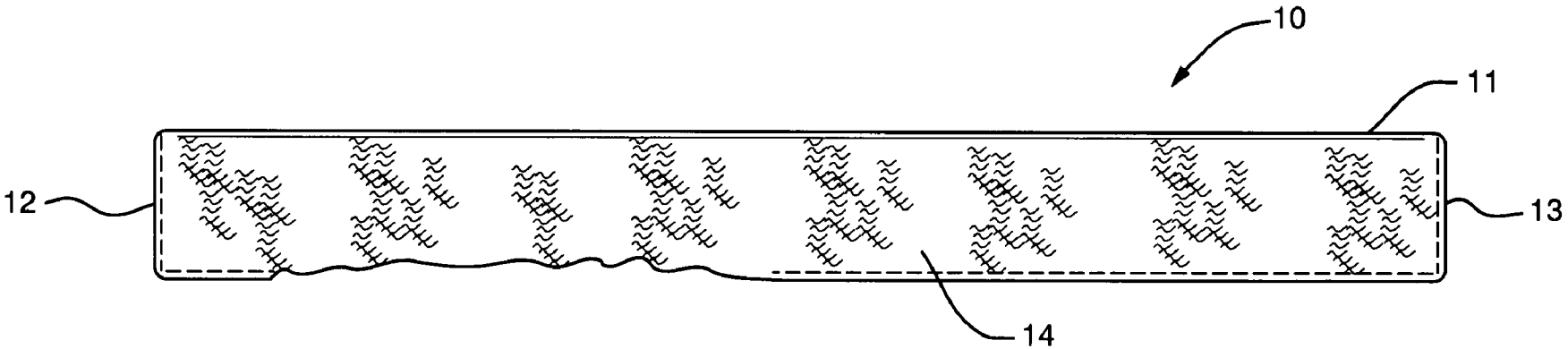
FIG. 1 is a schematic side elevational view of an embodiment of the invention.
Figure 2:
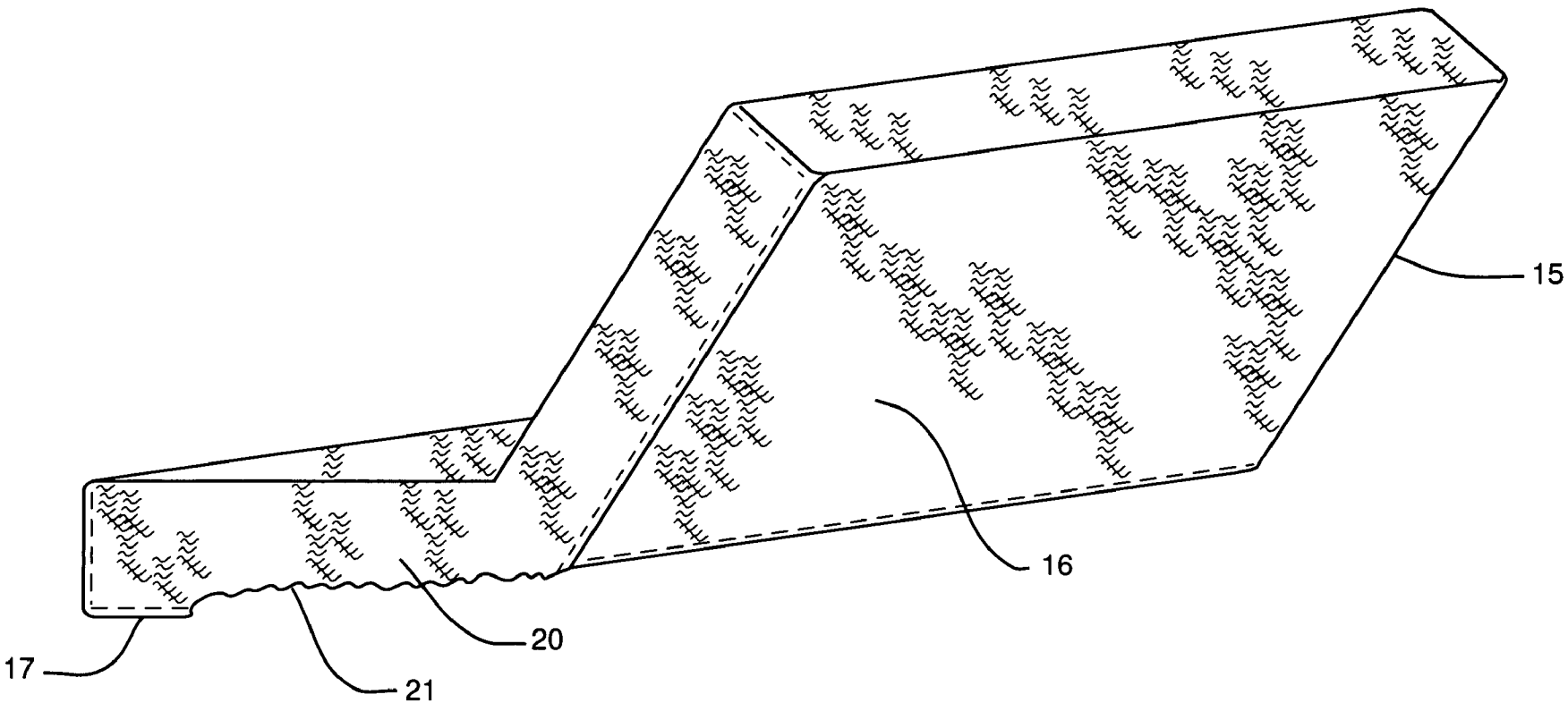
FIG. 2 is a schematic perspective view of the first embodiment.

In accordance with the first embodiment of the invention, the device, generally indicated by reference character 10 (FIGS. 1 and 2) is made of stretchable textile material known in the art to permit a snug fit over a limited degree of variance in length, width, and thickness of the futon mattress. It includes an upper panel 11, first and second end panels 12 and 13, first and second side panels 14 and 15, a rear panel 16, and a bottom panel 17. The assembly of the above parts provides a downwardly-extending opening having a continuous peripheral edge 20, including elastic side portions 21. Thus, the device may be installed upon a conventional futon mattress without the use of slide fasteners or tools. It is to be noted that the elastic side edges permit the mattress to be flexed between planar and non-planar configuration, as may be observed by comparing FIGS. 1 and 2.

Figure 3:
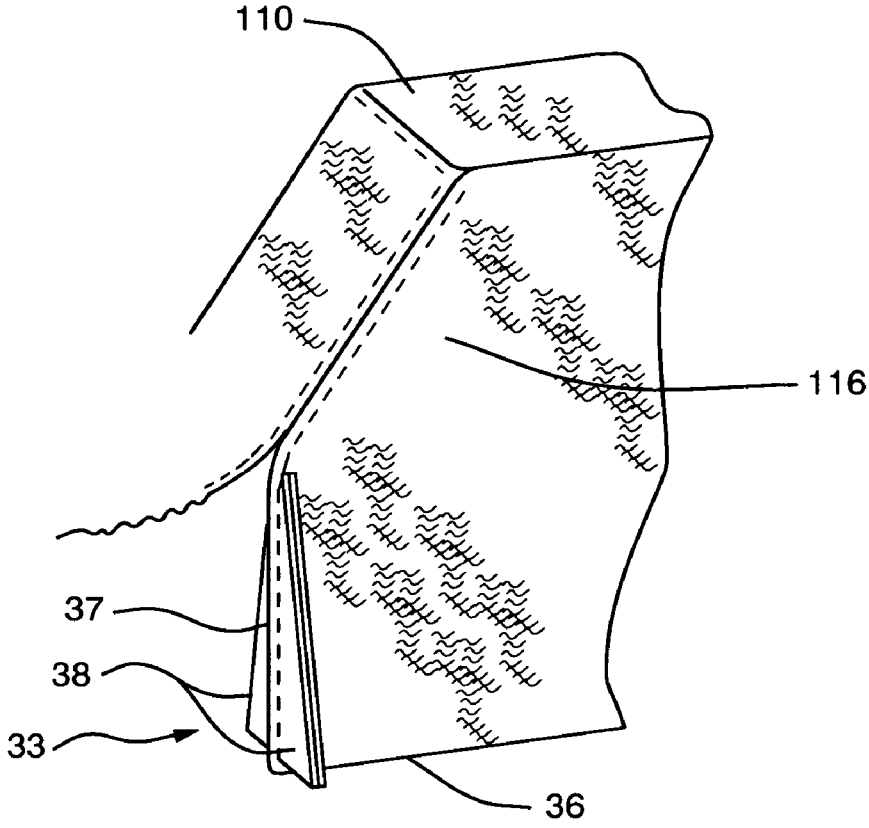
FIG. 3 is a schematic view of a second embodiment of the invention.

Turning now to the second embodiment of the invention (FIGS. 3 and 4), to avoid needless repetition, certain of the component parts have been designated by similar reference characters with the additional prefix "1". The second embodiment is best suited for use with futon couches having a wood frame, and which resemble a conventional couch when the mattress is in erected condition. It differs from the first embodiment in the provision of a depending flap 33 which is interconnected to the rear panel 116 and which folds out of the way when the mattress is placed in sleeping condition.

Figure 4:
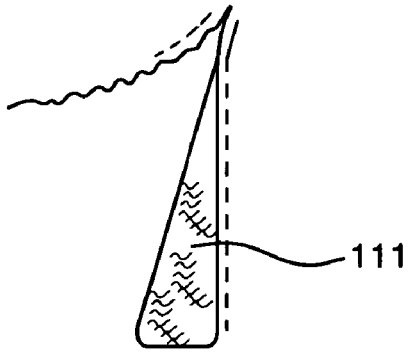
FIG. 4 is a fragmentary schematic perspective view of the second embodiment showing certain of the component parts in altered relative condition.

As seen in FIG. 4, the elastic side edges extend upwardly to the point of the downwardly-extending flap, thus providing additional convenience in installation. The flap 33 includes a lower horizontal edge 36, vertical side edges 37, as well as a stiffening tab 38 at each side of the edge 36 of double thickness fabric to provide additional stiffness when the futon mattress is in erected condition.

Installation of the second embodiment is generally similar to that in the first embodiment, with the elastic peripheral edge stretching as required. An additional degree of stretch extends partially up the upper panel 111 for this purpose. Once installed, the rear of the futon structure which normally includes the erectile mechanism, may be concealed by the depending flap.

I wish it to be understood that I do not consider the invention to be limited to the details of structure shown and described in the specification, for obvious modifications will occur to those skilled in the art to which the invention pertains.

I claim:

1. In a futon mattress cover including a top panel, contiguous side panels, a rear panel, and a bottom panel defining a continuous peripheral edge having longitudinal and transversely-extending portions, the improvement comprising said longitudinal portions of said side panels being formed by elastic members which expand and contract as an enclosed mattress is moved from erect to flattened condition; said rear panel having a downwardly-extending flap interconnected to a lower edge thereof, said flap being interconnected to said rear panel by a seam to enable folding when an enclosed mattress is placed in planar condition; and triangularly-shaped stiffening tabs positioned at side edges of said flap.

* * * * *